United States Patent [19]

Kondo

[11] 4,201,038

[45] May 6, 1980

[54] ALARM ELECTRONIC WATCH

[75] Inventor: Kenichi Kondo, Tokyo, Japan

[73] Assignee: Kabushiki Kaisha Daini Seikosha, Japan

[21] Appl. No.: 900,005

[22] Filed: Apr. 25, 1978

[51] Int. Cl.[2] ..... G04C 21/34; G04C 21/38

[52] U.S. Cl. ..... 368/73; 368/85; 368/251

[58] Field of Search ..... 58/19 R, 38 R, 57.5

[56] References Cited

U.S. PATENT DOCUMENTS

| | | | |
|---|---|---|---|
| 3,664,116 | 5/1972 | Emerson et al. | 58/38 R X |
| 3,940,919 | 3/1976 | Yasuda et al. | 58/38 R |
| 3,946,549 | 3/1976 | Cake | 58/38 R |

*Primary Examiner*—S. J. Witkowski

*Attorney, Agent, or Firm*—Robert E. Burns; Emmanuel J. Lobato; Bruce L. Adams

[57] ABSTRACT

An electronic alarm watch including an oscillator for developing a repetitive time standard signal, a dividing circuit for dividing the time standard signal to develop repetitive output signals, and a counting circuit receptive of one of the repetitive output signals of the dividing circuit for counting the same to develop a count representing passage of time. A first waveform shaping circuit receives the output signal of the counting circuit and a higher repetition rate output signal of the dividing circuit for developing a pulse signal at a repetition rate equal to that of the counting circuit output signal and having a pulse width equal to that of the dividing circuit output signal. A coincidence detector detects when the count of the counting circuit and an alarm time signal coincide and develops an output signal in response to this condition. A second waveform shaping circuit receives the output of the coincidence detector for developing in response thereto a pulse signal having a width greater than the pulse width of the output pulse of the first waveform shaping circuit. An alarm responds to an output of the dividing circuit and an enabling signal for developing an alarm signal. A memory circuit responsive to the respective output signals of the first and second waveform shaping circuits applies an enabling signal to the alarm in response to the output of the second waveform shaping circuit, and terminates the enabling signal in response to the output of the first waveform shaping circuit. Accordingly, an alarm signal is developed when coincidence between the counting circuit count and the alarm time signal is detected, and the alarm signal is automatically terminated after an interval equal to the repetition rate of the first waveform shaping circuit output signal.

4 Claims, 2 Drawing Figures

OSCILLATOR
DIVIDER
÷ 10
÷ 6
TIME COUNTER CIRCUIT
ALARM TIME COUNTER CIRCUIT
DECODER
DECODER
DRIVER
DRIVER
DISPLAY DEVICE
COINCIDENCE DETECTION CIRCUIT
WAVE FORM SHAPING CIRCUIT
ALARM PREVENTION INPUT
MEMORY CIRCUIT
WAVE FORM SHAPING CIRCUIT i
j
k

ALARM ELECTRONIC WATCH

BACKGROUND OF THE INVENTION

The present invention concerns an alarm electronic watch which is able to control alarm time over a continual range and to automatically stop the alarm after a predetermined alarm duration.

In the prior art, there have been some methods used to stop operation of a watch alarm, either manually or automatically, after one minute from coincidence of present time and alarm time in order that the alarm setting time be different from the present time stored in a counting circuit. However, such an automatic alarm stopping mechanism was not adopted in practice, so that such kind of watch has been very inconvenient for users. Further, since the life of a watch battery is extremely shortened due to a high current, such as 10 mA, for one minute alarm operation if a buzzer is used, the foregoing technique could not be adopted for wrist watches. Another method defined the continual range of alarm duration by a time-constant of a capacitor and a resistance in an automatic alarm stopping mechanism, which requires a holding circuit separated from a time-counting system of a watch and requires a large value capacitor and additional discrete electronic parts added to an integrated timepiece circuit. Therefore it is inconvenient for use in a wrist watch and its continual range of alarm duration is varied by temperature change, so that it is unstable.

SUMMARY OF THE INVENTION

An object of the invention is to provide an electronic alarm watch which automatically enables an alarm for a predetermined alarm interval, and then automatically terminates the alarm.

Another object of the invention is to provide such an electronic alarm watch in which the interval of alarm operation is constant and insensitive to temperature changes.

The electronic watch according to the present invention includes a time counting circuit having a constant period, not influenced by temperature change, to count an output signal of a temperature-compensated quartz oscillating circuit. Associated circuitry cooperates with the time counting circuit to operate an alarm for an interval determined by the time counting circuit. Therefore, the alarm interval is temperature stable and remains constant.

DESCRIPTION OF THE PREFERRED EMBODIMENT

Figures 1, 2:
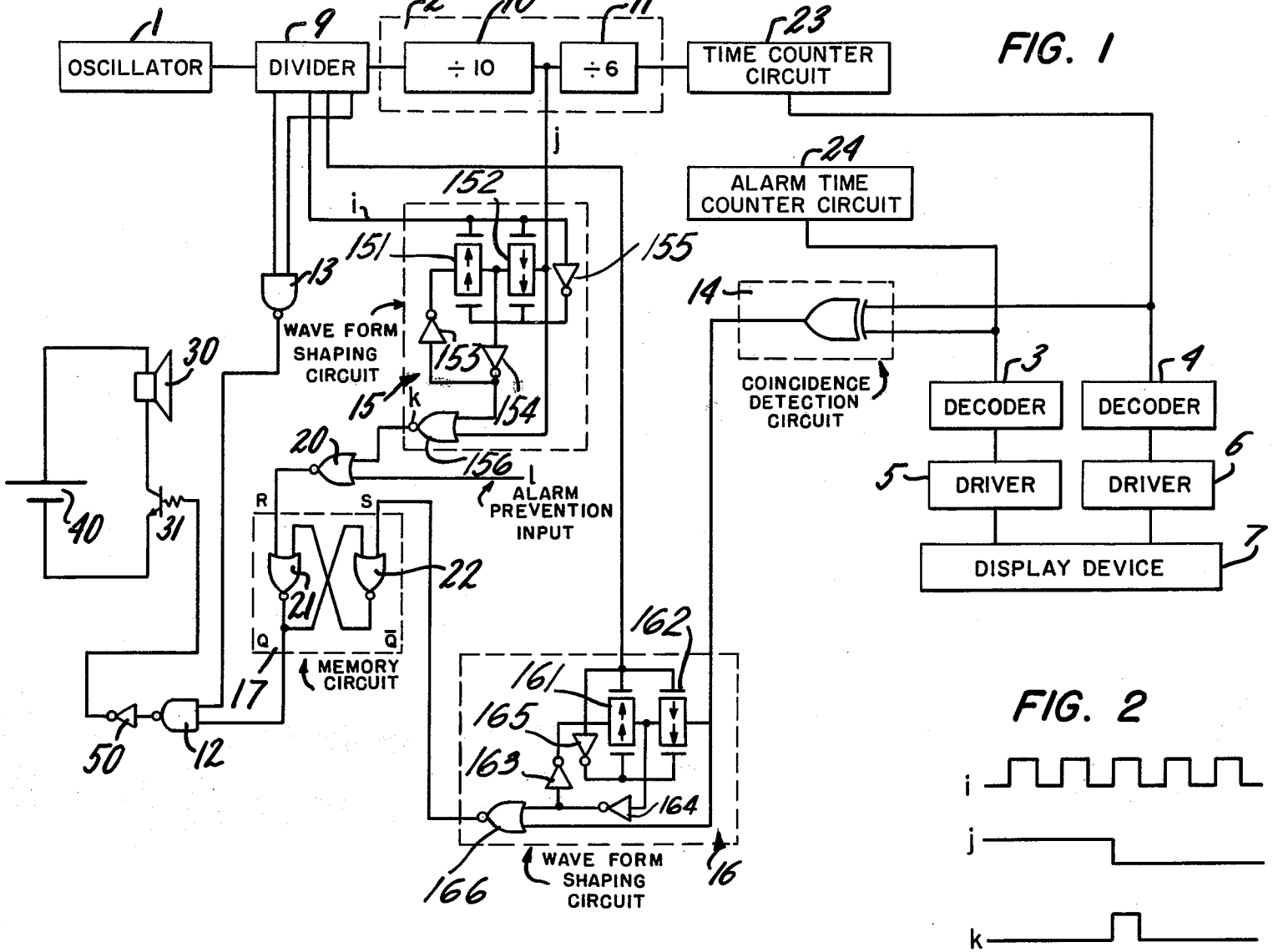
FIG. 1 is a circuit diagram of this invention.
FIG. 2 is a illustration of waveforms developed during operation of the invention.

FIG. 1 shows circuit structure of the preferred embodiment of the present invention. A repetitive time standard signal generated by an oscillator circuit 1 is divided down to a 1 Hz signal by a dividing circuit 9. A seconds counter circuit 2 comprised of a divide-by-ten counter 10 and divide-by-six counter 11 receives the 1 Hz signal and generates a minute signal having a period of one minute. The minute signal is applied to a time counter circuit 23 for counting minutes and hours, and develops a count representing the passage of time.

A time setting counter 24 is a counting circuit for setting an alarm time. The counter 24 can be set to a desired alarm time (ex. AM 6:34) by operating an external operation member (for example, a switch). The structure of the minute and hour counter circuits of said time counter circuit 23 and setting time counter 24 are the same.

The outputs of the time counter circuit 23 and the setting time counter 24 are respectfully changed into a display signal by the decoders 3 and 4. Said display signal is applied to the drivers 5 and 6, whereby time and alarm time information is displayed on a display device 7.

A coincidence detection circuit 14 detects coincidence between the contents of the time counter circuit 23 and the contents of the time setting counter 24. A wave shaping circuit 16 shapes a single pulse signal from an output of the coincidence detection circuit 14 and drives an alarm 30 by keeping a memory circuit 17 in a set condition. Additionally, a wave shaping circuit 15 generates a single reset pulse at ten second intervals by keeping memory circuit 17 in a reset condition.

The wave shaping circuits 15 and 16 have identical structure. Each includes a respective pair 151, 152 and 161, 162 of transmission gates connected in series. The gate electrodes of each gate in each pair of gates are connected to opposite polarity gate electrodes of the other gate in each pair of gates, and a respective inverter circuit 155 and 162 is connected between the pairs of gate electrodes connected together in the respective pairs 151, 152 and 161, 162 of gate circuits. Thus, a gate signal applied to the respective pairs 151, 152 and 161, 162 will be effective to render conductive one of the other of the transmission gates of each respective pair depending upon the polarity of the gate signal. The pulse signal "i" from divider 9 constitutes a gate signal for the gate pair 151, 152.

The wave shaping circuits 15 and 16 have respective NOR circuits 156 and 166 for developing output signals. The signals developed at the connections between the gate pairs 151, 152 and between the gate pairs 161, 162 are applied to respective input terminals of NOR circuits 156 and 166 through inverter circuits 154 and 164, respectively. And the outputs of inverter circuits 154 and 164 are fed back to gates 151 and 161 through inverter circuits 153 and 163, respectively. Therefore, inverter circuit pairs 153, 154 and 163, 164 are effective to apply a stable signal to an input terminal of the respective NOR circuits 156, 166 when gates 151, 161 are conductive.

The NAND-circuit 13 is a gate-circuit for applying an 8Hz modulation signal component to an alarm driving signal having a frequency of 4,096 Hz. The NAND circuit 12 is a gate-circuit for switching ON and OFF to control application of the alarm driving signal to the alarm 30. An inverter 50 has an amplifying function and inverts an output of NAND-circuit 12. An output signal from the inverter 50 is applied to an alarm driving circuit 31, whereby the alarm 30 is driven by the modulated driving signal having components of 4,096 Hz and 8 Hz, and a battery 40.

Next, the operation of the described embodiment of this invention will be described with reference to FIG. 2 which illustrates waveforms of signals developed during operation of the circuit illustrated in FIG. 1.

Oscillating circuit 1 constitutes means for developing a repetitive time standard output signal having a repetition rate defining passage of time. The dividing circuit 9 receives the time standard signal and divides the same to develop a 1 Hz repetitive output signal, and other higher frequency output signals. The counting circuit 10 receives the $1H_z$ dividing circuits output signal for developing a count which represents tens of seconds.

Output signal "j" of the 10-second counter 10 in the time counting circuit is an input to the first waveform shaping circuit 15. In order to use the comparatively high frequency pulse output of the dividing circuit 9 as a control signal of the waveform shaping circuit 15, output "k" of the waveform shaping circuit 15 is shaped into a single narrow pulse having the same width as pulse signal "i" and is an input to the reset terminal R of the memory 17 through the OR circuit 20. Since the memory 17 is comprised of an R-S flipflop and since the state of the input set terminal S of the NOR circuit 22 is normally "0", the state of the output Q of the NOR circuit (22) is normally "1". Therefore, the buzzer 30 is not driven since there is no signal for causing turn-on of the transistor 31 which comprises the alarm driving circuit.

If the content of the counter 10 of the time counter circuit 2 coincides with the content of the alarm setting time counter 24 the output state of the coincidence detector circuit 14 turns to "0" from "1" and is shaped to a short width pulse by applying the coincidence detector output to the waveform shaping circuit 16. The waveform shaping circuit 16 is comprised of a latch circuit the same as the waveform shaping circuit 15 described above, but the pulse width of waveform shaping circuit 16 output signal is longer than the width of signal "i". When the signal having the longer single pulse width from the shaping circuit 16 is applied to the set-terminal S of the NOR circuit 22, the output Q of the NOR circuit 21 changes to the "1" state from the "0" state and accordingly the buzzer 30 is driven. The Q output of the memory 17 is applied to the gate 12 together with an output signal from the gate 13. Gate 13 receives from the dividing circuit 9 two repetitive signals. Accordingly, the gate 13 itself develops a repetitive output signal which is applied to gate 12 to repetitively enable the gate 12. The output of gate 12 is in turn applied to the inverter 50 to bias the transistor 31 to a conductive state and energize the buzzer or alarm 30. Because of the repetitive nature of the gate 13 output signal the transistor 31 is repetitively rendered conductive and non-conductive so that alarm 30 will emit a tone alarm signal.

Next, after ten seconds have elapsed, a single pulse signal "k" is applied to the reset terminal R of the NOR-circuit 21, and accordingly, the output state of the NOR circuit 21 returns again to "0" and therefore the buzzer 30 is stopped being driven. The driving frequency of the buzzer 30 is determined by signals of the dividing circuit 9. And if it is desired that the buzzer operation be stopped before ten seconds have elapsed, a single pulse alarm terminating signal "1", which is produced by a manually operated switch, is applied to the OR circuit 20 to reset memory 17 and accordingly the buzzer operation can be immediately stopped.

As mentioned above, this invention is an alarm electronic watch which is effectively able to accomplish automatically and precisely stopping alarm operation by simple circuits operated by a low current by means of using time signals developed in a counting circuit without including any holding circuit to set alarm duration.

What I claim is:

1. An electronic alarm watch comprising, in combination:

means for developing a repetitive time standard signal having a repetition rate defining passage of time;

a dividing circuit receptive of said time standard signal for dividing the same and for developing repetitive output signals having respective repetition rates less than the repetition rate of said time standard signal;

a counting circuit receptive of one of the output signals of said dividing circuit for counting the output signal and for developing a count representative of the passage of time;

a first waveform shaping circuit receptive of the output signal of said counting circuit and a higher repetition rate output signal of said dividing circuit for developing a pulse signal at a repetition rate equal to that of said counting circuit output signal and having a pulse width equal to that of said dividing circuit output signal;

a coincidence detecting circuit for detecting when the count of said counting circuit and an alarm time signal coincide and for developing an output signal in response to the detected coincidence between the count of said counting circuit and said alarm time signal;

a second waveform shaping circuit receptive of the output of said coincidence detecting circuit for developing in response to said coincidence detecting circuit output signal a pulse signal having a pulse width greater than the pulse width of said first waveform shaping circuit output signal;

alarm means receptive of an output signal of said dividing circuit and responsive to an enabling signal for developing a repetitive alarm signal at a repetition rate determined by the repetition rate of the dividing circuit output signal applied thereto when said enabling signal is applied thereto; and means comprising a memory circuit responsive to the respective output signals of said first and second waveform shaping circuits for applying said enabling signal to said alarm means in response to the output of said second waveform shaping circuit so that detection of coincidence between the count developed by said counting circuit and said alarm time signal is effective to enable said alarm means, and for terminating said enabling signal in response to the output of said first waveform shaping circuit so that said alarm signal is terminated within a predetermined time equal to the repetition rate of said first waveform shaping circuit output signal.

2. An electronic alarm watch according to claim 1, further comprising means for applying an alarm terminating signal to said memory before the output signal of said first waveform shaping circuit is automatically applied to said memory in order to terminate said enabling signal and thereby terminate said alarm signal before the same is terminated by operation of said first waveform shaping circuit.

3. An electronic alarm watch according to claim 2, wherein said means for applying an alarm terminating signal is a two-input OR gate having a first input receptive of the output of said waveform shaping circuit, a second input receptive of said alarm terminating signal, and an output port connected for applying the output of said first waveform shaping circuit and said alarm terminating signal to said memory.

4. An electronic watch according to claim 1, further comprising an alarm time counter circuit for developing a count representative of an alarm time and for developing as an output signal the alarm time signal corresponding to said count.

* * * * *